US007694904B2

(12) United States Patent
Thome

(10) Patent No.: US 7,694,904 B2
(45) Date of Patent: Apr. 13, 2010

(54) AUXILIARY DRIVE

(75) Inventor: William S. Thome, York, PA (US)

(73) Assignee: Metso Minerals Industries, Inc., Waukesha, WI (US)

( * ) Notice: Subject to any disclaimer, the term of this patent is extended or adjusted under 35 U.S.C. 154(b) by 687 days.

(21) Appl. No.: 11/562,526

(22) Filed: Nov. 22, 2006

(65) Prior Publication Data

US 2008/0035771 A1 Feb. 14, 2008

Related U.S. Application Data

(60) Provisional application No. 60/863,768, filed on Oct. 31, 2006.

(51) Int. Cl.
*B02C 19/00* (2006.01)

(52) U.S. Cl. ..... 241/101.2; 241/299

(58) Field of Classification Search ..... 241/101.71, 241/101.8, 101.2, 299
See application file for complete search history.

(56) References Cited

U.S. PATENT DOCUMENTS

| | | | | |
|---|---|---|---|---|
| 3,466,936 | A | 9/1969 | Gaupin | |
| 4,978,080 | A * | 12/1990 | Weitekamp | 241/101.2 |
| 6,543,586 | B1 * | 4/2003 | Willetts | 188/73.1 |
| 6,719,227 | B2 * | 4/2004 | Scuccato | 241/36 |

FOREIGN PATENT DOCUMENTS

SU 1502096 8/1989

OTHER PUBLICATIONS

Australian Examination Report re: Australian App. No. 2007231613 dated May 1, 2009.

* cited by examiner

*Primary Examiner*—Dana Ross
*Assistant Examiner*—Matthew G Katcoff
(74) *Attorney, Agent, or Firm*—Rathe Patent & IP Law

(57) ABSTRACT

An apparatus includes a shell connection mechanism configured to be actuated between a connected state in which a mechanism is connected to a shell and a disconnected state and an actuator configured to move the first mechanism while the first mechanism is in the connected state to move the shell.

22 Claims, 4 Drawing Sheets

AUXILIARY DRIVE

CROSS-REFERENCE TO RELATED PATENT APPLICATION

The present application claims priority under 35 USC Section 119 from U.S. Provisional Application Ser. No. 60/863,768 filed on Oct. 31, 2006 by William S. Thome and entitled AUXILLARY DRIVE, the full disclosure of which is hereby incorporated by reference.

BACKGROUND

Grinding mills are used to grind materials to extract minerals. Gearless grinding mills employ ring motors to rotate the shells of the mills. Repair of such motors or the shells may be difficult and time-consuming.

DETAILED DESCRIPTION OF THE EXAMPLE EMBODIMENTS

Figure 1:
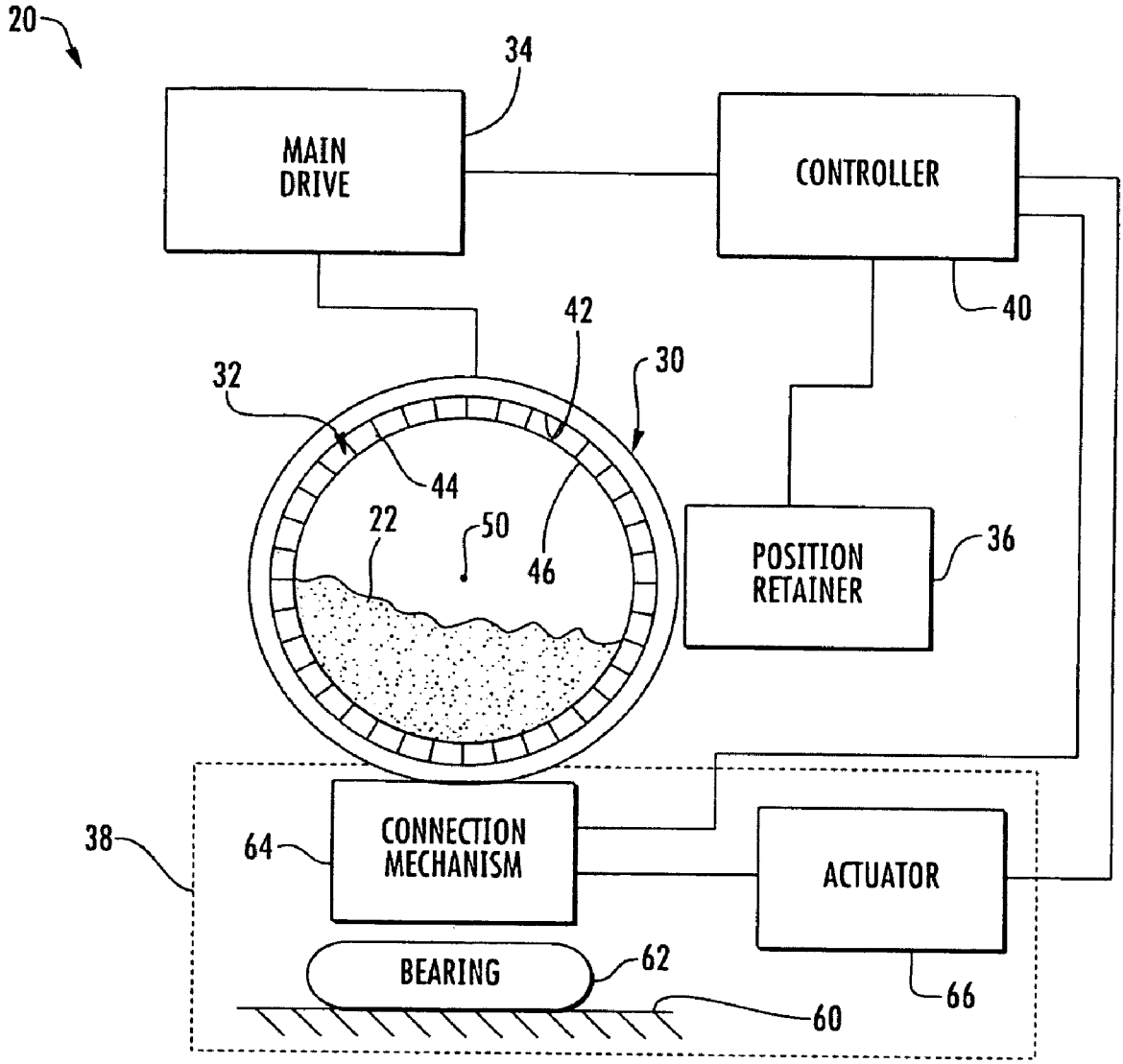
FIG. 1 is a schematic illustration of a grinding mill according to one example embodiment.

FIG. 1 is a schematic illustration of a grinding mill 20 according to an example embodiment. Grinding mill 20 is configured to grind rocks and other aggregate 22 for such purposes as extracting minerals. Grinding mill 20 includes shell 30, liner 32, main drive 34, position retainer 36, auxiliary drive 38 and controller 40. As will be described in more detail hereafter, auxiliary drive 38 facilitates easier repair or replacement of shell 30, liners 32, main driver 34, position retainer 36 or other mill components when main drive 34 is inoperable.

Shell 30 comprises a cylindrical drum or cylinder having one or more walls forming an interior surface 42. Liner 32 comprises one or more structures secured to interior surface 42 so as to line the interior of shell 30. Liner 32 protects interior surface 42 from wear and damage during grinding. In the example illustrated, liner 32 is removable from shell 30, facilitating replacement liner 32 upon wear of liner 32. In one embodiment, liner 32 comprises a plurality of liner segments 44 secured and arranged end-to-end along interior surface 42. In one embodiment, such liner segments 44 may be formed from a resilient or elastomeric material such as rubber. In yet other embodiments, liner segments 44 may be formed from one or more metals. In still other embodiments, liner segments 44 may be formed from both elastomeric and metallic materials. In other embodiments, liner segments 44 may be formed from other materials. In one embodiment, liner segments 44 may collectively form and even or smooth mill in interior surface 46. In other embodiments, liner segments 44 may collectively form an undulating grinding mill interior surface to assist in lifting aggregate 22 during rotation of shell 30. In one embodiment, liner 32 may include multiple distinct types of segments 44 including lifters and wear bars. In yet other embodiments, liner 32 may be omitted.

Main drive 34 comprises a mechanism operably coupled to shell 30 and configured to rotationally drive shell 30 about one or more axes. For purposes of this disclosure, the term "coupled" shall main the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" means that two elements are either directly connected or connected via one or more intermediate elements (such as an intermediate drive train or transmission) such that force, such as torque, may be transmitted between such elements.

According to an example embodiment, main drive 34 is configured to rotationally drive shell 30 axis 50. Main drive 34 is configured to continuously rotate the shell 30 a full 360 degrees about axis 50 during grinding without interruption or pause. According to one embodiment, main drive 34 comprises a gearless drive, a drive that transmits torque to shell 30 to rotate shell 30 without gears interacting upon shell 30. According to one example embodiment, main drive 34 comprises a ring motor. In particular, main drive 34 features motor rotor elements bolted or otherwise secured to shell 30 and a stationary rotor assembly surrounding the rotor elements, wherein shell 30 functions as the rotating element of a large low-speed synchronous motor and wherein the speed at which shell 30 is rotated may be changed by varying the frequency of electrical currents to the motor. In other embodiments, main drive 34 may comprise other presently known or future developed mechanisms for rotationally driving shell 30 360° about axis 50 in a continuous fashion.

Position retainer 36 comprises a mechanism or arrangement of components configured to retain positioning of shell 30 against rotation. According to one embodiment, position retainer 36 is further configured to brake or substantially slow rotation of shell 30. According to one embodiment, position retainer 36 is substantially stationary in that position retainer 36 is supported or held so as to not move relative to shell 30 about axis 50 or relative to axis 50. Position retainer 36 merely moves between a connected or position retaining state and a disconnected state.

Figure 4:
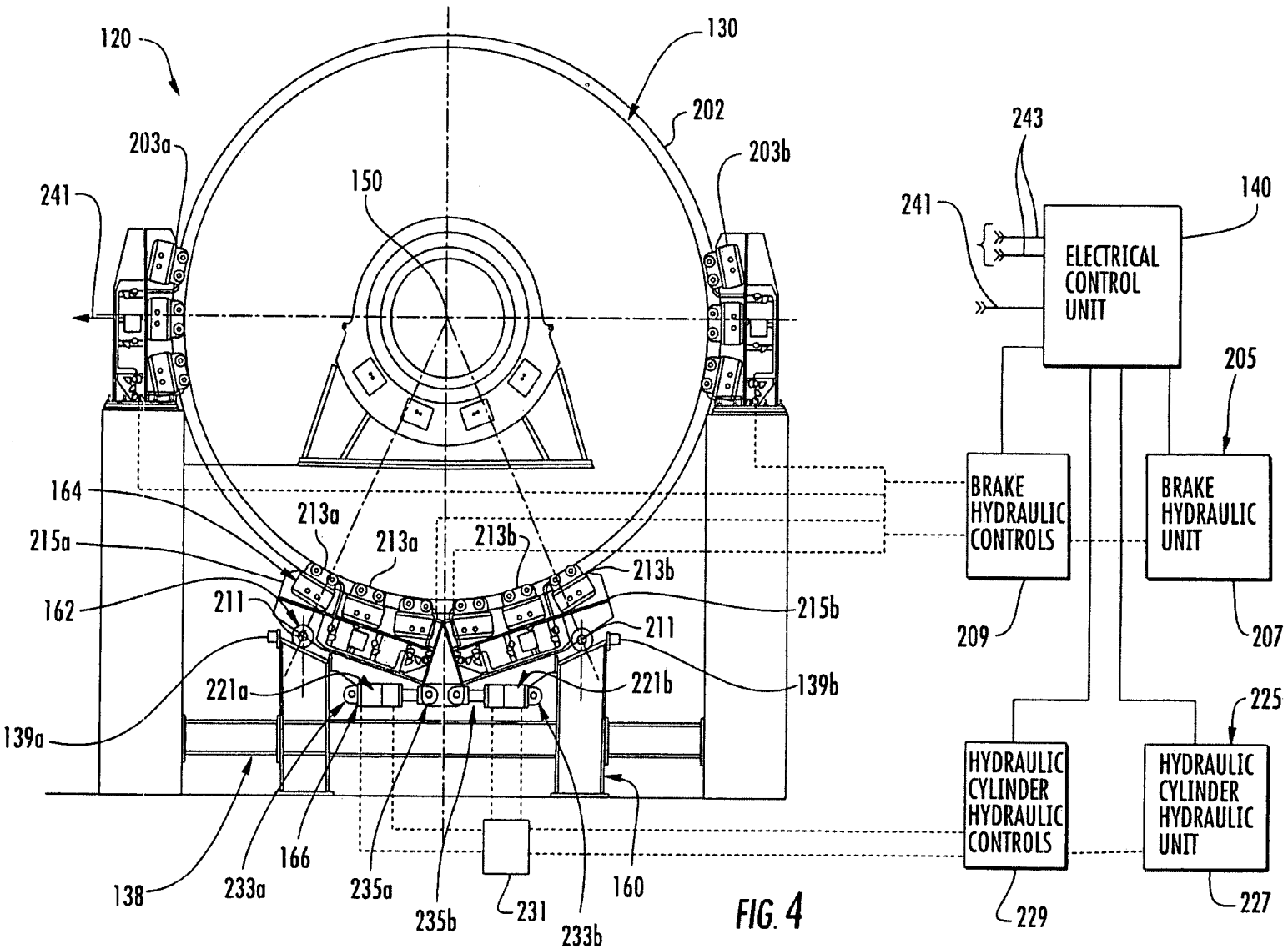
FIG. 4 is an end elevational view of the grinding mill of FIG. 2 with portions omitted and with portions schematically shown for purposes of illustration according to an example embodiment.

According to one embodiment, position retainer 36 utilizes a radially extending flange (an example of which is shown in FIG. 4) extending from an exterior of shell 30 and comprises one or more mechanisms configured to clamp against the flange to frictionally engage the flange and hold shell 30 against rotation. In one embodiment, such clamping mechanisms may comprise one or more caliper assemblies (examples of which are shown in FIG. 4). In such an embodiment, position retainer 36 may be used to both hold shell 30 against rotation and may also be used to brake rotation of shell 30.

In yet other embodiments, position retainer 36 may comprise other mechanisms for releasably securing and retaining shell 30 against rotation at selected times. For example, in another embodiment, retainer 36 may alternatively include one or more structures along an exterior of shell 30 configured to be connected to by one or more actuatable or movable connectors which may be moved into and out of connection with the one or more structures secured to shell 30. For example, in one embodiment, position retainer 36 may include an annular band or ring along an exterior of shell 30, wherein the ring includes one or more detents, such as holes, notches or teeth, and wherein the connectors comprise one or more pins, projections or teeth, respectively. During grinding, such connectors are moved by one or more actuators out of connection or engagement with the detents. When shell 30 is to be retained in position, the connectors are moved into engagement with the detents.

Auxiliary drive 38 comprises a drive configured to rotate shell 30 about axis 50. Auxiliary drive 38 may be used to drive shell 30 about axis 50 when main drive 34 is inoperable to facilitate repair or replacement of shell 30, liners 32, main drive 34 or other mill components. Although auxiliary drive 38 is illustrated as already incorporated into grinding mill 20, auxiliary drive 38 may comprise a separate set or arrangement of components configured to be added to an existing grinding mill system. For example, auxiliary drive 38 may be provided as an after-market drive configured to provide an existing grinding mill with enhanced versatility or ease of repair.

Auxiliary drive 38 generally includes support 60, bearing 62, connection mechanism 64 and actuator 66. Support 60 comprises one or more structures configured to support bearing 60 to a connection mechanism 64. Support 60 may comprise any variety of base structures such as a framework of structures or a foundation of one or more materials. The exact configuration a support 60 may vary depending upon the configuration of bearing 62.

Bearing 62 comprises an arrangement of one or more structures between support 60 and connection mechanism 64. Bearing 62 is configured to movably support connection mechanism 64 or guide movement of connection mechanism 64 relative to or about axis 50. According to one example embodiment, bearing 62 may comprise one or more rotatable members configured to rotate along one or more surfaces of support 60. For example, in one embodiment, bearing 62 may comprise one or more rollers which roll along one or more surfaces or tracks provided by support 60. In yet another embodiment, bearing 62 may comprise ball bearings or rod bearings. In still other embodiments, bearing 62 may comprise a tongue and groove arrangement or other arrangement of complementary structures by which connection mechanism 64 slides along a predetermined path.

Connection mechanism 64 comprises one or more mechanisms configured to be selectively actuatable between a connected position or state and a disconnected position or state with respect to shell 30. In the connected state, connection mechanism 64 is releasably secured to shell 30 such that any movement of connection mechanism 64 either about axis 50 or tangential to axis 50 also results in a corresponding degree of movement of shell 30 about axis 50. In the disconnected state, connection mechanism 64 is withdrawn from or otherwise disengaged from shell 30 such that shell 30 may rotate about axis 50 relative to connection mechanism 64, such as when main drive 34 is continuously rotation shell 30 or such as when connection mechanism 64 is being moved relative to shell 30 while in the disconnected state. According to one example embodiment, connection mechanism 64 includes one or more selective connectors configured to be actuated between the connected and disconnected states via hydraulics, pneumatics, mechanical or electrical actuation.

According to one embodiment, connection mechanism 64 utilizes the radially extending flange (an example of which is shown in FIG. 4) extending from an exterior of shell 30 and comprises one or more mechanisms configured to clamp against the flange to frictionally engage the flange and connect to shell 30. In one embodiment, such clamping mechanism may comprise one or more caliper assemblies (examples of which are shown in FIG. 4). In such an embodiment, connection mechanism 64 may be additionally used to provide additional braking of shell 30 against rotation.

In yet other embodiments, connection mechanism 64 may comprise other mechanisms for being releasably secured to or connected to shell 30 at selected times. For example, in another embodiment, connection mechanism 64 may alternatively include one or more structures along an exterior of shell 30 configured to be connected to by one or more actuatable or movable connectors which may be moved into and out of connection with the one or more structures secured to shell 30. For example, in one embodiment, connection mechanism 64 may include an annular band or ring along an exterior of shell 30, wherein the ring includes one or more detents, such as holes, notches or teeth, and wherein the connectors comprise one or more pins, projections or teeth, respectively. During grinding, such connectors are moved by one or more actuators out of connection or engagement with the detents. When shell 30 is to be connected to connection mechanism 64, the connectors are moved into engagement with the detents.

Actuator 66 comprises one or more mechanisms or devices configured to move connection mechanism 64 either about axis 50 or tangential to axis 50. In one embodiment, actuator 66 may comprise one or more hydraulic cylinder assemblies. For example, in one embodiment, actuator 66 may comprise a first hydraulic cylinder assembly having a first cylinder end secured to support 60 (or another stationary structure) and a second piston end secured to connection mechanism 64, and a second hydraulic cylinder assembly having a first cylinder and security support 60 (or another stationary structure) and a second piston end secured to connection mechanism 64, wherein the first and second hydraulic cylinder assemblies face one another such that their pistons extend or move away from the corresponding cylinders in opposite directions. In yet another embodiment, actuator 66 may comprise a dual-acting hydraulic cylinder assembly. In yet other embodiments, actuator 66 may comprise other linear actuators such as pneumatic cylinder assemblies or electric solenoids. In particular embodiments, actuator 66 may alternatively comprise a motor configured to rotationally drive a cam operably connected to connection mechanism 64 so as to move connection mechanism 64.

Controller 40 comprises one or more processing units configured to generate control signals that are transmitted to and from main drive 34, position retainer 36 and auxiliary drive 38. In other embodiments, a separate controller may alternatively be provided for main drive 34. Such processing units may be collectively located at a single location or may be dispersed amongst separate units or devices. For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 40 may be embodied as part of one or more application-specific integrated circuits (ASICs). Unless otherwise specifically noted, the controller is not limited to any specific combination of hardware circuitry and software, nor to any particular source for the instructions executed by the processing unit.

In the example illustrated, controller 40 generates control signals which selectively direct main drive 34 to rotationally drive shell 30 about axis 50. Controller 40 generates control signals directing position retainer 36 to selectively brake rotation of shell 30 to either control or adjust a speed at which shell 30 is rotated or to stop rotation of shell 30. Controller 40 further generates control signals actuating connection mechanism between the connected and disconnected states and causing actuator to move connection mechanism 64 about axis 50 or tangential to axis 50 at selected times.

According to one embodiment, controller 40 generates the first and second control, wherein (1) the connection mechanism 64 actuates to the connected state and actuator 66 moves the connection mechanism 64 while in the connected state in response to the first control signals and (2) the position retainer 36 engages shell 30 to retain the shell 30 in place, the connection mechanism 64 actuates to the disconnected state and the actuator 66 moves the connection mechanism 64 while in the disconnected state in response to the second control signals. As a result, the following steps are performed:

(1) connecting a first structure to a grinding mill shell at a first position;
(2) moving the first structure to a second position to rotate the shell;
(3) connecting a second structure to the shell to hold the shell against rotation;
(4) disconnecting the first structure from the shell; and
(5) moving the first structure back to the first position.

The performance of such steps enables a shell 30 to be inched along about axis 50 to reposition shell 30 as needed such as during repair of shell 30 or main drive 34, when main drive 34 is inoperable.

Figure 2:
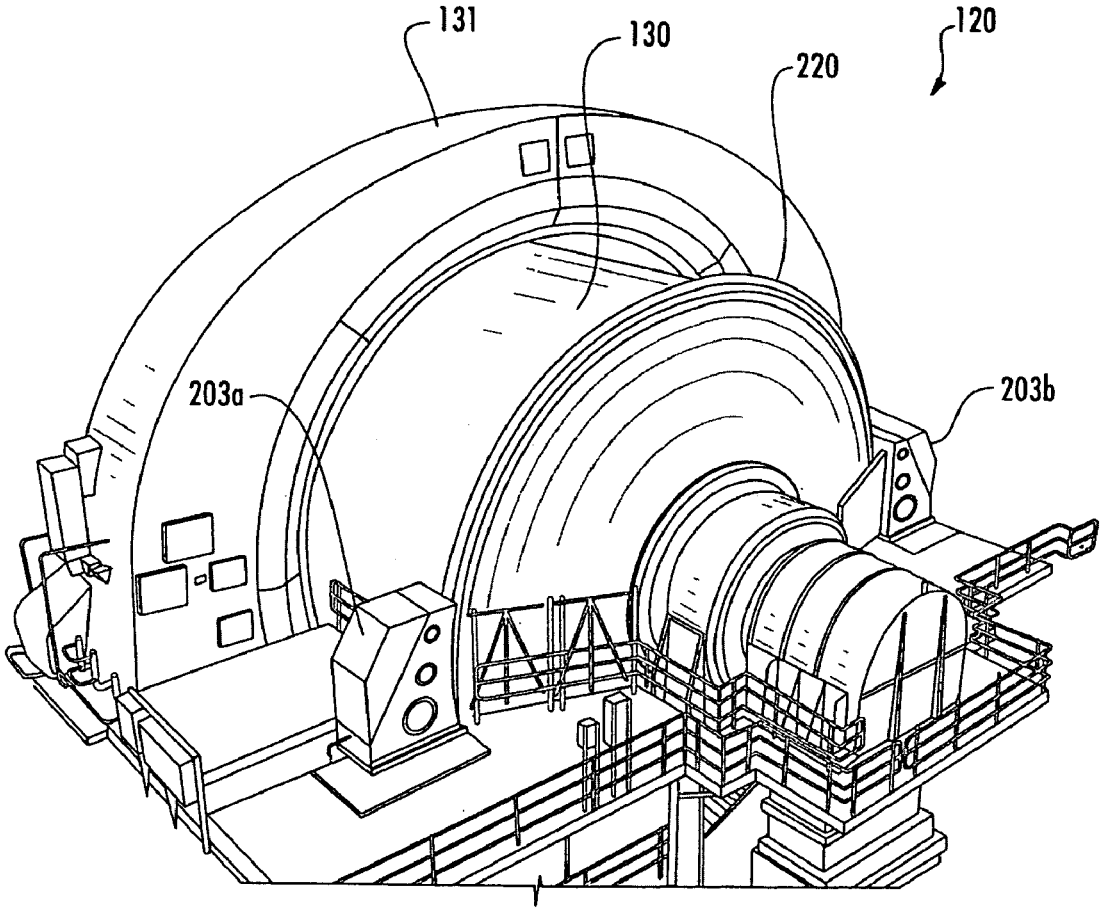
FIG. 2 is a left perspective view of another embodiment of the grinding mill of FIG. 1 according to an example embodiment.
Figure 3:
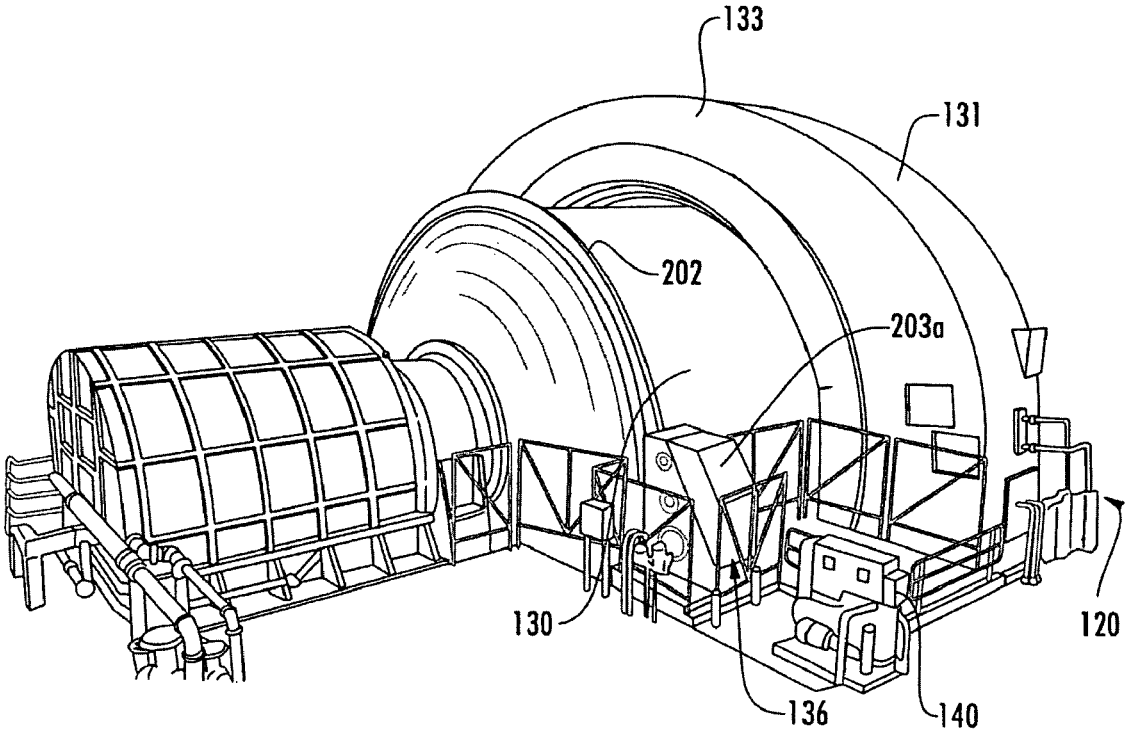
FIG. 3 is a right perspective view of the grinding mill of FIG. 2 according to an example embodiment.

FIGS. 2-4 illustrate grinding mill 120, one example embodiment of grinding mill 20.

FIGS. 2 and 3 are left and right perspective views, respectively, of grinding mill 120. FIG. 4 is an end elevational view of grinding mill 120 with portions omitted and with portions schematically shown for purposes of illustration. Grinding mill 120 includes shell 130, ring motor 131 (shown in FIGS. 2 and 3), braking system 136, auxiliary drive 138 (shown in FIG. 4), sensors 139*a*, 139*b* (collectively referred to as sensors 139) and controller 140 (shown in FIG. 4). Shell 130 comprises a hollow cylindrical structure or drum which is rotationally driven by ring motor 131. Ring motor 131 includes rotor elements (not shown) bolted or otherwise secured to shell 130 any stationary stator assembly 133 surrounding such rotor elements. In operation, shell 130 operates as a rotating element of a large low-speed synchronous motor. The speed at which shell 130 is rotated may be varied by changing a frequency of occurrence to the motor.

Braking system 136 includes brake flange 202, stationary brake calipers 203*a* and 203*b* (collectively referred to as calipers 203) and hydraulic system 205. Brake flange 202 comprises a ring or band circumferentially extending about and coupled to shell 130. Flange 202 provides surfaces against which calipers 203 and 203*a* frictionally engage or grip to brake or slow rotation of shell 130.

FIG. 4 illustrates calipers 203*a* and 203*b* of braking systems 136 in more detail. As shown by FIG. 4, calipers 203*a* and 203*b* wrap around and face opposite sides of flange 202. Calipers 203*a* and 203*b* are actuatable between an engaged position in which the calipers clamp about flange 202 to slow or stop rotation of shell 130 and a disengaged or withdrawn position in which shell 130 is permitted to rotate under power from ring motor 131. In the example illustrated, calipers 203*a* and 203*b* also serve as a position retainer and cooperate with auxiliary drive 138 in inching shell 130 about axis 150.

Hydraulic system 205 actuates calipers 203*a* and 203*b* between engaged and disengaged positions. Hydraulic system includes hydraulic unit 207 and hydraulic controls 209. Hydraulic unit 207 supplies hydraulic power. For example, in one embodiment, hydraulic unit 207 comprises a pump. Hydraulic controls 209 comprise valve mechanisms configured to selectively direct hydraulic fluid so as to actuate calipers 203*a* and 203*b* in response to control signals from controller 140. In other embodiments, calipers 203*a* and 203*b* may be actuated by other non-hydraulic means or may comprise structures other than calipers configured to brake or slow rotation of shell 130.

Auxiliary drive 138 is to be used to rotate or inch shell 130 along about axis 150 when ring motor 131 is inoperable. Auxiliary driver 138 includes support 160, bearing 162 and connection mechanism 164. Support 160 comprises one or more structures configured to support bearing 160 and connection mechanism 164. Support 160 may comprise any a variety of base structures such as a framework of structures or a foundation of one or more materials. In the example illustrated, support 160 comprises a pair of angled or ramped surfaces extending tangent to shell 130 along which bearing 162 rides or otherwise bears against. In other embodiments, support 160 may have other configurations.

Bearing 162 comprises an arrangement of one or more structures between support 160 and connection mechanism 164. Bearing 162 is configured to movably support connection mechanism 64 or guide movement of connection mechanism 164 relative to or about axis 150. In the example embodiment illustrated, bearing 162 comprises one or more rotatable members configured to rotate along one or more surfaces of support 160. For example, in the embodiment illustrated, bearing 162 comprises one or more rollers 211 which roll along one or more surfaces or tracks provided by support 160. In yet another embodiment, bearing 162 may comprise ball bearings or rod bearings. In still other embodiments, bearing 162 may comprise a tongue and groove arrangement or other arrangement of complementary structures by which connection mechanism 164 slides along a predetermined path.

Connection mechanism 164 comprises one or more mechanisms configured to be selectively actuatable between a connected position or state and a disconnected position or state with respect to shell 130. In the connected state, connection mechanism 164 is releasably secured to shell 130 such that any movement of connection mechanism 164 either about axis 150 or tangential to axis 150 also results in a corresponding degree of movement of shell 130 about axis 150. In the disconnected state, connection mechanism 164 is withdrawn from or otherwise disengaged from shell 130 such that shell 130 may rotate about axis 150 relative to connection mechanism 164, such as when ring motor 131 is continuously rotating shell 130 or such as when connection mechanism 164 is being moved relative to shell 130 while in the disconnected state.

In the example embodiment illustrated, connection mechanism 164 utilizes flange 202 of braking system 136 and comprises one or more mechanisms configured to clamp against the flange to frictionally engage the flange and connect to shell 130. In the example embodiment shown, the clamping mechanisms comprise one or more caliper assemblies 213*a* and 213*b* (collectively referred to as caliper assemblies 213) carried and supported by a sled or carriages 215*a* and 215*b* which is coupled to rollers 211. In such an embodiment, connection mechanism 164 may be additionally used to provide additional braking of shell 130 against rotation. In the example embodiment, calipers 213 are hydraulically actuated between connected and disconnected states with respect to shell 130 using power from hydraulic unit 207 and controlled via hydraulic controls 209. In other embodiments, rather than sharing hydraulic system 205 with braking system 136, calipers 213 may be hydraulically actuated by a dedicated hydraulic power unit and hydraulic control. In still other embodiments, calipers 213 may be actuated by other means such as pneumatics, mechanical or electrical actuation.

In yet other embodiments, connection mechanism 164 may comprise other mechanisms for being releasably secured to or connected to shell 130 at selected times. For example, in another embodiment, connection mechanism 164 may alternatively include one or more structures along an exterior of shell 130 configured to be connected to by one or more actuatable or movable connectors which may be moved into and out of connection with the one or more structures secured to shell 130. For example, in one embodiment, connection mechanism 64 may include an annular band, flange or ring along an exterior of shell 30, wherein the ring includes one or more detents, such as holes, notches or teeth, and wherein the connectors comprise one or more pins, projections or teeth, respectively. During grinding, such connectors are moved by one or more actuators out of connection or engagement with the detents. When shell 130 is to be connected to connection mechanism 164, the connectors are moved into engagement with the detents.

Actuator 166 comprises one or more mechanisms or devices configured to move connection mechanism 164 either about axis 150 or tangential to axis 150. In the example illustrated, actuator 166 comprises two hydraulic cylinder assemblies 221*a* and 221*b* (collectively referred to as cylinder assemblies 221) and hydraulic system 225. Cylinder assembly 221*a* has a first cylinder end 233*a* pivotally secured to support 160 (or another stationary structure) and a second piston end 235*a* pivotally secured to carriage 215*a* of connection mechanism 164, and cylinder assembly 221*b* has a first cylinder end 233*b* pivotally secured to support 160 (or another stationary structure) and a second piston end 235*b* pivotally secured to carriage 215*b* of connection mechanism 164, wherein the first and second hydraulic cylinder assemblies 221 face one another such that their pistons extend or move away from the corresponding cylinders in opposite directions.

Hydraulic system 225 supplies hydraulic power to cylinder assemblies 221*a* and 221*b*. Hydraulic system 225 includes hydraulic unit 227, hydraulic controls 229 and manifold 231. Hydraulic unit 227 supplies pressurized hydraulic fluid. In the example illustrated, hydraulic unit 227 comprises a pump. Hydraulic controls 229 comprise one or more valve mechanisms configured to selectively supply pressurized hydraulic fluid to cylinder assemblies 221 via manifold 231.

In other embodiments, actuator 166 may comprise a dual-acting hydraulic cylinder assembly. In yet other embodiments, actuator 166 may comprise other linear actuators such as pneumatic cylinder assemblies or electric solenoids. In particular embodiments, actuator 166 may alternatively comprise a motor configured to rotationally drive a cam operably connected to connection mechanism 64 so as to move connection mechanism 164.

Sensors 139 sense or detect positions of connection mechanism 64. In the particular example illustrated, sensors 139 comprise limit switches which detect or sense the positioning of carriages 215*a* and 215*b* along the ramp surfaces provided by supports 160. Sensors 139 generate signals which are transmitted to controller 140 to assist in control of actuator 166. In other embodiments, sensors 139 may comprise other sensing mechanisms or may be omitted.

Controller 140 comprises one or more processing units configured to generate control signals that are transmitted to braking system 136 and auxiliary drive 138. Controller 140 coordinates operation of braking system 136 and auxiliary drive 138 to inch shell 130 about axis 150 as desired. As indicated by line 241, controller 140 receives electrical signals from caliper assemblies 203 and 213 indicating the current state of such caliper assemblies. As indicated by lines 243, controller 140 receives electrical signals from sensors 139 further indicating the current positions of carriages 215 relative to shell 130. Based upon such signals, controller 140 generates control signals causing hydraulic controls 209 to selectively open or close calipers 203 and 213 and causing hydraulic controls 229 to selectively actuate cylinder assemblies 221 to move carriages 215 and a selected direction about axis 150. In particular, calipers 213 are actuated to the left and are clamped onto flange 202. Actuation of calipers 213 (the connection mechanism) occurs by selectively extending and retracting hydraulic cylinder assemblies 221. When one of cylinder assemblies 221 is being extended, the other of cylinder assemblies 221 is being retracted. Upon engagement or connection of calipers 213 to flange 202, stationary brake calipers 203 (position retainer) are released from flange 202 and calipers 213 are actuated to the right, causing shell 130 to rotate or inch in a counterclockwise direction (as seen in FIG. 4) about axis 150. Once shell 130 has a rotated a desired distance or upon calipers 213 reaching their limit of travel (as sensed by sensors 139) stationary calipers 203 are clamped onto flange 202 to hold mill 130 in place. Thereafter, calipers 213 are released or disconnected and once again actuated to their initial first position. This sequence is repeated until the desired extent of rotation of shell 130 is achieved. This sequence may be reversed to turn shell 130 in an opposite direction.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a grinding mill shell;

a braking system including:

a brake rotor coupled to the shell; and at least one caliper configured to clamp about the rotor;

a connection mechanism configured to be actuated between a connected state in which the connection mechanism is connected to the shell and a disconnected state, wherein the connection mechanism is configured to clamp about the rotor when in the connected state;

an actuator configured to move the connection mechanism while the connection mechanism is in the connected state to move the shell; and a main drive configured to rotationally drive the shell without use of the actuator.

2. The apparatus of claim 1, wherein the actuator is configured to move the connection mechanism while the connection mechanism is in the disconnected state

3. The apparatus of claim 1, wherein the brake rotor clamps about the rotor to retain the shell against movement while the connection mechanism is in the disconnected state.

4. The apparatus of claim 1 further comprising:

a support; and a bearing mechanism between the support and the connection mechanism.

5. The apparatus of claim 4, wherein the bearing mechanism comprises a rotating member.

6. The apparatus of claim 1, wherein the actuator comprises a linear actuator.

7. The apparatus of claim 6, wherein the linear actuator comprises a first hydraulic cylinder assembly coupled to the connection mechanism.

8. The apparatus of claim 7 further comprising a second hydraulic cylinder assembly coupled to the connection mechanism and facing the first hydraulic cylinder assembly.

9. The apparatus of claim 1, wherein the connection mechanism is movable about a rotational axis of the shell.

10. The apparatus of claim 1, wherein the connection mechanism is configured to frictionally grasp a portion of the shell in the connected state.

11. The apparatus of claim 1 further comprising a controller configured to generate first and second control signals, wherein (1) the connection mechanism actuates to the connected state and actuator moves the connection mechanism while in the connect state in response to the first control signals and (2) the at least one caliper clamps against the rotor to retain the shell in place, the connection mechanism actuates to the disconnected state and the actuator moves the connection mechanism while in the disconnected state in response to the second control signals.

12. The apparatus of claim 1 wherein the main drive is a gearless drive.

13. The apparatus of claim 1 wherein the main drive comprises a ring motor.

14. The apparatus of claim 1 further comprising a controller configured to generate first and second control signals, wherein the actuator moves the connection mechanism while the connection mechanism is in the connected state in response to the first control signals and move the connection mechanism while the connection mechanism is in the disconnected state in response to the second control signals.

15. A gearless grinding mill comprising:

a shell;

a ring motor configured to rotationally drive the shell;

a braking system comprising:

a brake rotor at least partially about the shell; and at least one first caliper configured to selectively clamp against the brake rotor;

at least one second caliper configured to selectively clamp against the brake rotor; and an actuator coupled to the at least one second caliper and configured to move the at least one second caliper relative to the at least one first caliper while clamped against the brake rotor to rotate the shell.

16. The apparatus of claim 1, wherein the shell comprises a drum having an interior that receives material to be ground.

17. The apparatus of claim 16 further comprising a removable liner within the interior of the drum.

18. The apparatus of claim 1, wherein the connection mechanism is linearly translatable along an axis tangential to the shell.

19. The apparatus of claim 18, wherein the connection mechanism is rollable along a surface.

20. The apparatus of claim 18 further comprising at least one ramp tangential to the shell, wherein the at least one second caliper is rollable along the at least one ramp.

21. The apparatus of claim 1, wherein the at least one caliper of the braking system comprises:

a first caliper on a first side of the shell; and a second caliper on a second opposite side of the shell, wherein the connection mechanism is between the first caliper and the second caliper on a bottom of the shell.

22. The gearless grinding mill of claim 15, wherein the at least one second caliper is linearly translatable along an axis tangential to the shell.

* * * * *